US007665680B2

(12) United States Patent
Anderson et al.

(10) Patent No.: US 7,665,680 B2
(45) Date of Patent: Feb. 23, 2010

(54) FOOD WASTE DISPOSER CLEAN-OUT MECHANISM

(75) Inventors: Scott W. Anderson, Racine, WI (US); Joseph G. Farmerie, Muskego, WI (US); Nicholas J. Hirsch, Wind Lake, WI (US); Steven P. Hanson, Racine, WI (US); Cynthia C. Jara-Almonte, Kenosha, WI (US); Richard Junk, Elkhorn, WI (US)

(73) Assignee: Emerson Electric Co., St. Louis, MO (US)

( * ) Notice: Subject to any disclaimer, the term of this patent is extended or adjusted under 35 U.S.C. 154(b) by 682 days.

(21) Appl. No.: 11/164,976

(22) Filed: Dec. 13, 2005

(65) Prior Publication Data

US 2007/0131808 A1 Jun. 14, 2007

(51) Int. Cl.
*B02C 23/36* (2006.01)

(52) U.S. Cl. ..... 241/46.013; 241/191; 241/296

(58) Field of Classification Search ..... 241/46.013, 241/46.014, 46.015, 46.016, 162, 191, 296, 241/297, DIG. 38

See application file for complete search history.

(56) References Cited

U.S. PATENT DOCUMENTS

| | | | | |
|---|---|---|---|---|
| 2,819,847 | A * | 1/1958 | Hauser | 241/46.015 |
| 3,211,389 | A * | 10/1965 | Sherman, Jr. | 241/46.013 |
| 3,439,878 | A * | 4/1969 | Reaux | 241/46.013 |
| 4,134,555 | A * | 1/1979 | Rosselet | 241/46.013 |
| 6,007,006 | A * | 12/1999 | Engel et al. | 241/46.014 |
| 6,439,487 | B1 * | 8/2002 | Anderson et al. | 241/46.013 |
| 7,337,996 | B2 * | 3/2008 | Hanson et al. | 241/46.013 |
| 2003/0066914 | A1 * | 4/2003 | Jara-Almonte et al. | 241/46.013 |
| 2005/0236502 | A1 | 10/2005 | Anderson et al. | |

FOREIGN PATENT DOCUMENTS

WO WO-2004/080598 A2 9/2004

* cited by examiner

*Primary Examiner*—Jimmy T Nguyen
(74) *Attorney, Agent, or Firm*—Harness, Dickey & Pierce, P.L.C.

(57) ABSTRACT

A shredder plate assembly for a food waste disposer includes a disk with one or more water slinging devices attached, so that water flowing into the disposer flows over the water slinging device and against the inside of the disposer housing as the disk rotates.

14 Claims, 4 Drawing Sheets

FOOD WASTE DISPOSER CLEAN-OUT MECHANISM

BACKGROUND

The present disclosure relates generally to food waste disposers.

Food waste disposers are used to comminute food scraps into particles small enough to safely pass through household drain plumbing. A conventional disposer includes a food conveying section, a motor section, and a grinding mechanism disposed between the food conveying section and the motor section. The food conveying section includes a housing that forms an inlet for receiving food waste and water. The food conveying section conveys the food waste to the grinding mechanism, and the motor section includes a motor imparting rotational movement to a motor shaft to operate the grinding mechanism.

The grind mechanism that accomplishes the comminution is typically composed of a rotating shredder plate with lugs and a stationary grind ring. The motor turns the rotating shredder plate and the lugs force the food waste against the grind ring where it is broken down into small pieces. Once the particles are small enough to pass out of the grinding mechanism, they are flushed out into the household plumbing.

FIG. 1 illustrates portions of a typical grinding mechanism 10. The illustrated grinding mechanism 10 includes a rotating shredder plate 12 with swivel lugs 14 and a stationary grind ring 16. The grinding plate 12 is mounted to the motor shaft 18. The grind ring 16, which includes a plurality of notches 20 defining spaced teeth 21, is fixedly attached to an inner surface of a housing 22.

In the operation of the food waste disposer, the food waste delivered by the food conveying section to the grinding mechanism 10 is forced by the swivel lugs 14 against the teeth 21 of the grind ring 16. The edges of the teeth 21 grind the food waste into particulate matter sufficiently small to pass from above the grinding plate 12 to below the grinding plate 12 via gaps between the rotating and stationary members. Due to gravity, the particulate matter that passes through the gaps between the teeth 21 drops onto the upper end frame 24 and, along with water injected into the disposer, is discharged through a discharge outlet 26.

During the grinding process, waste particles can adhere to the surfaces of the grind mechanism components and to the interior of the grind section housing. In a typical kitchen application, the faucet is opened so that water runs into the disposer inlet to rinse and carry food waste through the grind mechanism during the grinding of food waste. Inadequate rinsing, however, can cause food build up and odor to occur. This can result in odors and even reduced grind performance if water passages in the disposer are plugged.

The present application addresses shortcomings associated with the prior art.

SUMMARY

A shredder plate assembly for a food waste disposer includes a disk with one or more water slinging devices attached, so that water flowing into the disposer flows over the water slinging device and against the inside of the disposer housing as the disk rotates.

In accordance with certain aspects of the disclosure, the water slinging device defines an opening therethrough. A fastener has first and second ends with a shoulder therebetween. The shoulder extends through the opening and the second end is fixed to the disk such that the water slinging device is rotatable about the shoulder. The shoulder defines a tapered portion and the opening defines a correspondingly tapered portion. The tapered portion of the shoulder and the tapered portion of the opening interact when the disk rotates to force the water slinging device against the disk.

In accordance with further aspects of the disclosure, a fixed water slinging device is attached to the disk, either in place of, or in addition to, the rotatable device. The fixed water slinging device defines a sloped surface over which water flows. To attach the fixed water slinging device to the disk, it defines a mounting tab extending therefrom and the disk defines an opening receiving the mounting tab in exemplary embodiments.

BRIEF DESCRIPTION OF THE DRAWINGS

Other objects and advantages of the invention will become apparent upon reading the following detailed description and upon reference to the drawings in which.

Figure 1:
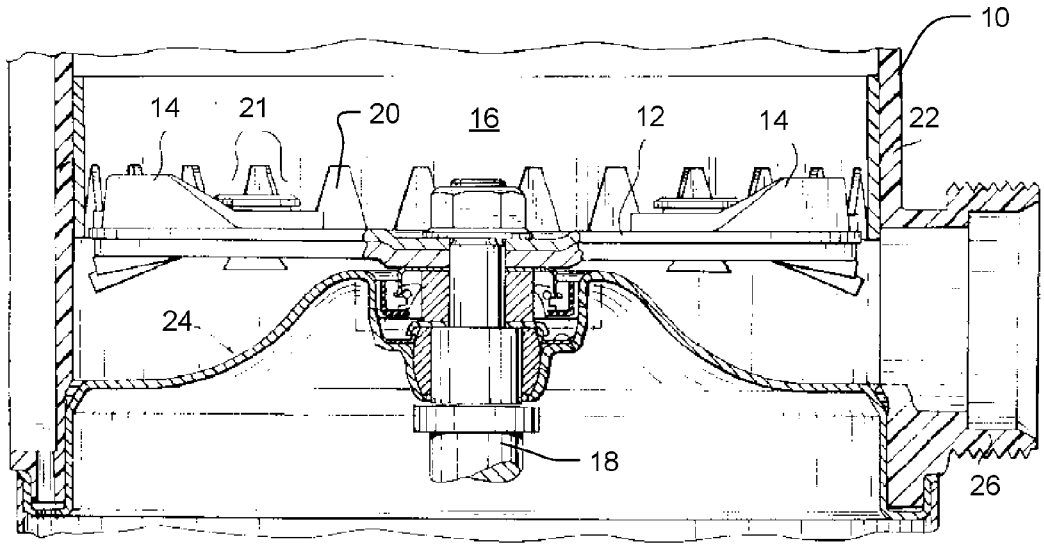
FIG. 1 (prior art)
FIG. 1 is a sectional view of a prior art food waste disposer grinding mechanism.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
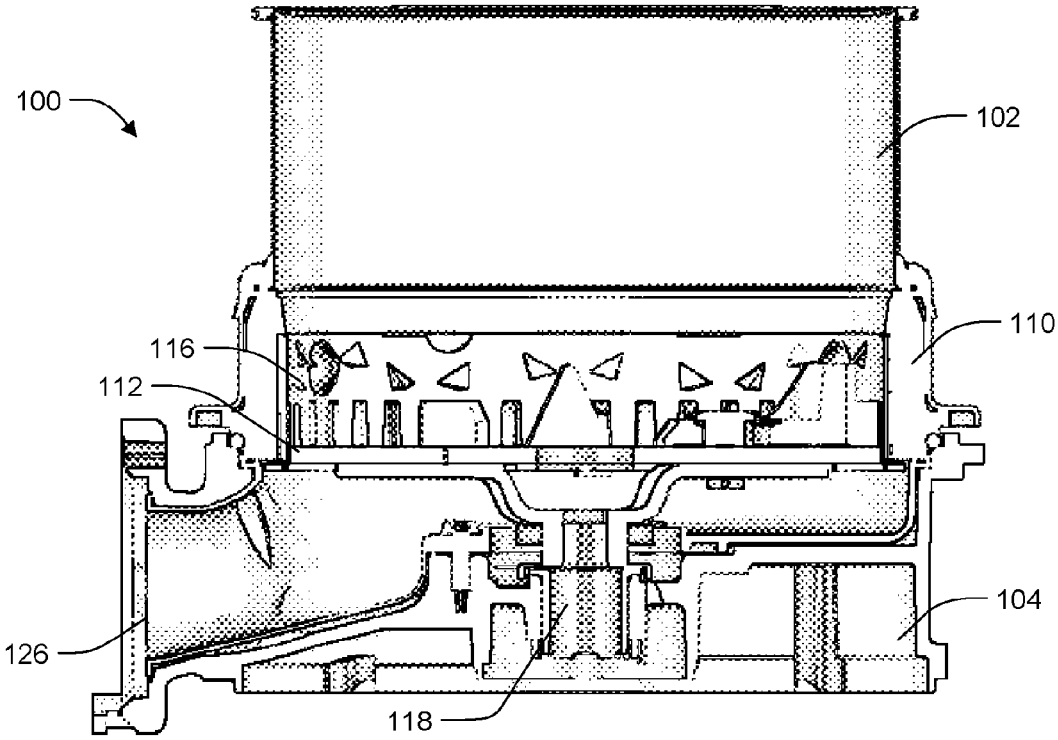
FIG. 2 is a sectional side view showing portions of a food waste disposer embodying aspects of the present disclosure.

FIG. 2 illustrates portions of an exemplary food waste disposer in accordance with the teachings of the present disclosure. The food waste disposer 100 includes a food conveying section 102 and a grinding mechanism 110, which is disposed between the food conveying section 102 and a motor section 104. The food conveying section 102 defines an inlet for receiving food waste and water, and conveys food waste to the grinding mechanism 110, which includes a stationary grind ring 116 that is fixedly attached to an inner surface of the housing of the grind mechanism 110. The motor section includes a motor imparting rotational movement to a motor shaft 118, which turns a rotating shredder plate assembly 112 relative to the stationary grind ring 116 to reduce food waste to small pieces. When the food waste is reduced to particulate matter sufficiently small, it passes from above the shredder plate assembly 112, and along with water injected into the disposer, is discharged through a discharge outlet 126.

Figure 3:
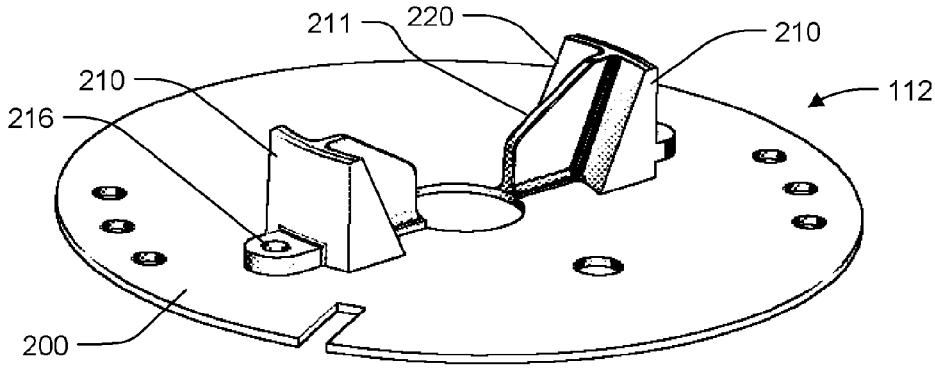
FIG. 3 is a perspective view of an exemplary shredder plate having a water slinging device attached as disclosed herein.

FIG. 3 illustrates a bottom perspective view of the water slinging device 210. The device 210 includes a mounting tab 212 that is received in a corresponding opening in the plate 200. The device 210 further defines an opening 216 though which a bolt or rivet can extend to attach the device 210 to the plate 200 as shown in FIG. 3. Sloped surfaces 220 are defined by the device 210 so that as water enters the grinding mechanism 110 and hits the rotating plate 200, it flows towards the outer portion of the plate 200 and up the sloped surfaces 220, which sling the water against the inner surfaces of the grinding mechanism 110 and food conveying section 102. As shown in FIG. 3, sloped surfaces 220 slope upwardly from plate 200 toward an outer portion of plate 200.

Figure 4:
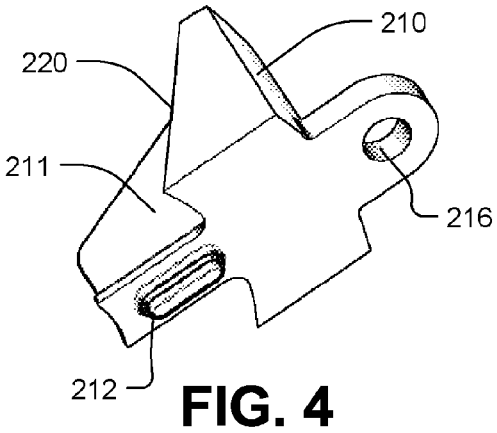
FIG. 4 is a perspective view of the water slinging device shown in FIG. 3.

FIG. 4 illustrates a bottom perspective view of the water slinging device 210. The device 210 includes a mounting tab 212 that is received in a corresponding opening in the plate 200. The device 210 further defines an opening 216 though which a bolt or rivet can extend to attach the device 210 to the plate 200 as shown in FIG. 3. Sloped surfaces 220 are defined by the device 210 so that as water enters the grinding mechanism 110 and hits the rotating plate 200, it flows towards the outer portion of the plate 200 and up the sloped surfaces 220, which sling the water against the inner surfaces of the grinding mechanism 110 and food conveying section 102.

Figure 5:
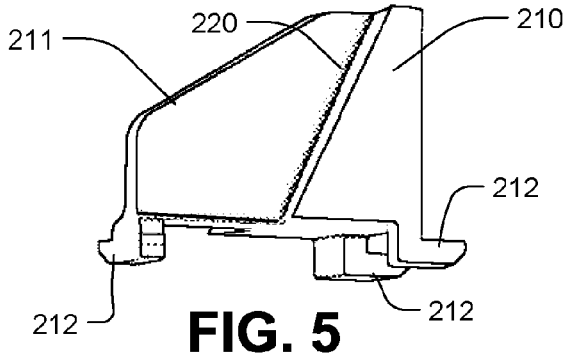
FIG. 5 is a perspective view of an alternative water slinging device.
Figure 6:
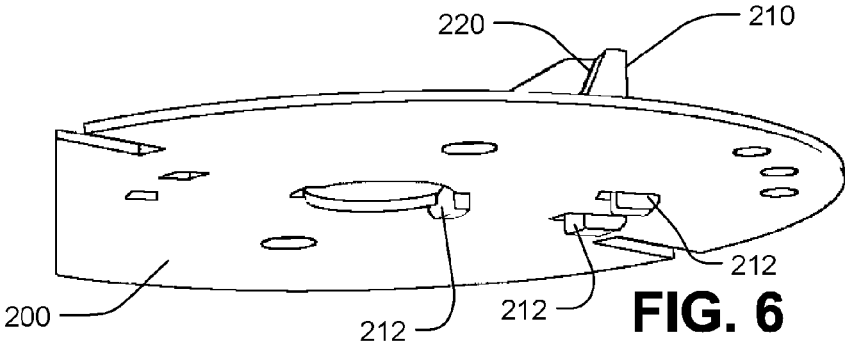
FIG. 6 is a perspective view of a shredder plate assembly having the water slinging device of FIG. 5 attached thereto.

As shown in FIG. 3, the illustrated water slinging devices 210 include a web portion 211 that extends radially inwardly on the plate 200 from sloped surface 220. The sloped surface 220 is oriented generally perpendicular to the web 211 and, as shown in FIG. 3, extends along the plate 200 generally perpendicularly from a vertical sidewall of web portion 211 where the vertical sidewall intersects the sloped surface 220, so that water running into the disposer's inlet is directed by web portion 211 to flow up the sloped surface 220 and against the inside of the disposer housing. FIG. 5 shows an alternative version of the fixed water slinging device 210 that defines three mounting tabs 212, which are received in corresponding slots in the plate 200 to attach the device 210 to the plate 200 as shown in FIG. 6.

Figure 7:
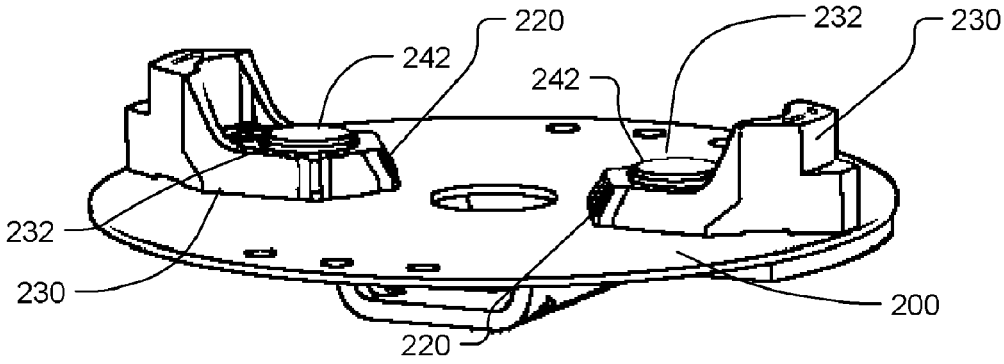
FIG. 7 is a perspective view of another shredder plate assembly having rotatable water slinging devices attached thereto.
Figure 8:
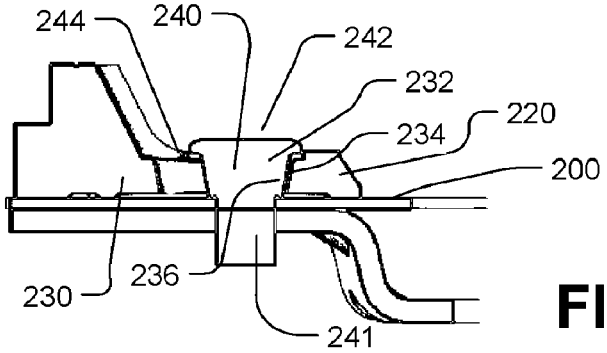
FIG. 8 is a side view in section of a portion of the shredder plate assembly of FIG. 7.

FIG. 7 shows another shredder plate assembly having rotating lugs 230 with sloped surfaces 220 for slinging water in a similar manner to the device 210 disclosed above. The water slinging lugs 230 are rotatably attached to the plate 200 with fasteners 232 such as rivets so that the lug 230 can rotate about the fastener 232. FIG. 8 is a side section view of a portion of the plate 200 with the water slinging lug 230 attached using the fastener 232. In the illustrated embodiment, the fastener 232 includes a shoulder 240 situated between a shank 241 and a head 242. The lug defines an opening 244 therethrough, and the head 242 defines a diameter larger than the width of the opening 244. The shoulder 240 extends through the opening 244 and the shank 241 is fixed to the plate 200, so that the lug 230 can rotate about the shoulder 240.

With known rotatable disposer lugs, the distance between the bottom of the rivet head and the top of the shredder plate is such that when the shredder plate rotates, the lug lifts so there is clearance between the bottom of the lug and the top of the shredder plate. Providing this tolerance insures that the lug can rotate freely about the fastener, but also allows water to flow under the lug. With prior art disposers, this wasn't recognized as a problem since the only purpose of the lug was to force food against the grind ring. In accordance with the teachings disclosed herein, it is desirable to prevent water from flowing under the lug 230, so that the water flows over the lug 230 and its sloped surface 220 to sling the water against the inner surfaces of the grind mechanism 110 and food conveying section 102.

Hence, the shoulder 240 of the fastener 232 defines a tapered portion 236, which corresponds to a tapered portion 234 defined by the opening 244 in the lug 230. When the lug 230 rotates about the shoulder 240, the tapered surfaces 234, 236 interact to create a hold-down force, holding the lug 220 against the plate 200, allowing less water to wash under the lug 230. This results in more water flowing over the lug 230 and up the sloped surfaces 220 to clean out the grind mechanism. In one exemplary embodiment, the tapered portion defines an angle of about 5° relative to the axis of the fastener 232.

Figure 9:
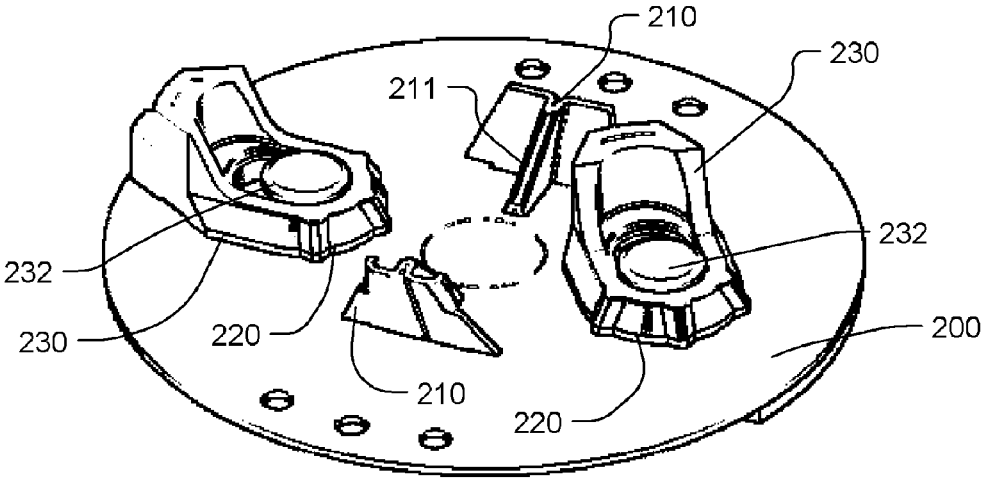
FIGS. 9 and 10 are a perspective views of further alternative shredder plate assemblies.
Figure 10:
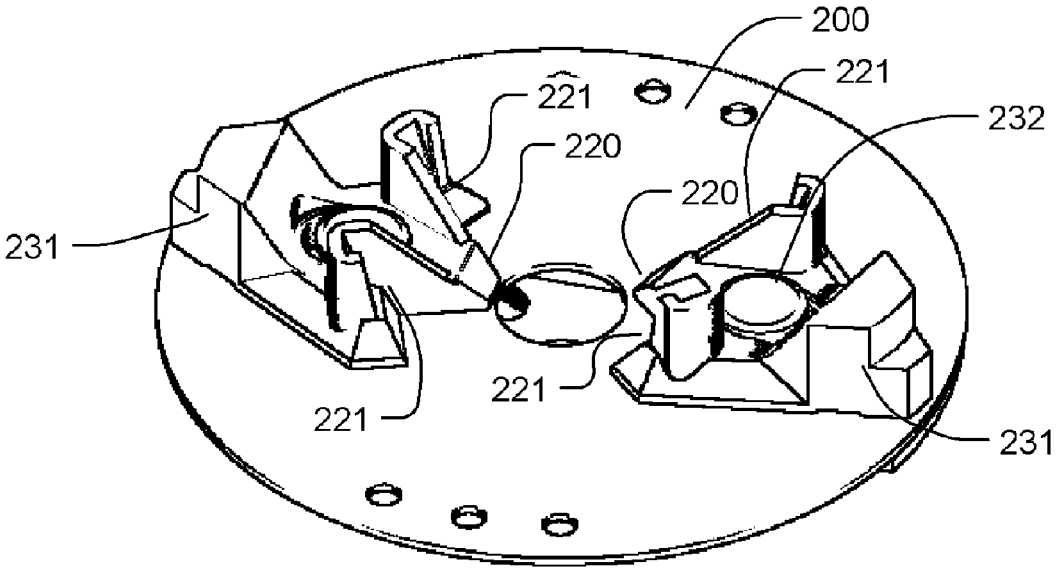

FIG. 9 shows another embodiment that includes fixed slinging devices 210 in addition to the rotating slinging lugs 230. A further embodiment is illustrated in FIG. 10, which employs an alternative rotating water slinging lug 231. The lugs 231 include additional sloped surfaces 221 generally defining a "V" shape to create additional water slinging action. Still further embodiments use both the lugs 231 shown in FIG. 9 in combination with fixed water slinging devices.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A shredder plate assembly for a food waste disposer, comprising: a disk;

a rotatable water slinging device defining an opening therethrough;

a fastener having first and second ends and a shoulder therebetween, the shoulder extending through the opening, the first end defining a head and the second end defining a shank fixed to the disk such that the water slinging device is rotatable about the shoulder;

the shoulder defining a tapered portion; the opening defining a correspondingly tapered portion; and wherein the tapered portion of the shoulder and the tapered portion of the opening interact when the disk rotates to force the water slinging device against the disk.

2. The shredder plate assembly of claim 1, further comprising a second rotatable water slinging device.

3. The shredder plate assembly of claim 1, further comprising a fixed water slinging device attached to the disk such that the fixed water slinging device does not rotate relative to the disk.

4. The shredder plate assembly of claim 3, further comprising a second fixed water slinging device attached to the disk such that the second fixed water slinging device does not rotate relative to the disk.

5. The shredder plate assembly of claim 3, wherein the fixed water slinging device defines a mounting tab extending therefrom, and the disk defines an opening receiving the mounting tab.

6. A shredder plate assembly for a food waste disposer, comprising: a disk; a fixed water slinging device attached to the disk, the fixed water slinging device having a sloped surface that slopes upwardly from the disk toward an outer portion of the disk and a web portion extending radially inwardly along the disk from the sloped surface, the sloped surface oriented generally perpendicular to the web portion wherein the sloped surface extends along the disk generally perpendicularly from a vertical sidewall of the web portion where the vertical sidewall intersects the sloped surface.

7. The shredder plate of claim 6, including another fixed water slinging device, the another fixed water slinging device having a sloped surface that extends upwardly from the disk toward an outer portion of the disk and a web portion extending radially inwardly alone the disk from the sloped surface, the sloped surface oriented generally perpendicular to the web portion wherein the sloped surface extends along the disk generally perpendicularly from a vertical sidewall of the web portion where the vertical sidewall intersects the sloped surface, the fixed water slinging devices attached to the disk on opposite sides of the disk from each other.

8. The shredder plate of claim 6, further comprising: a rotatable water slinging device defining an opening therethrough; a fastener having first and second ends and a shoulder therebetween, the shoulder extending through the opening, the first end defining a head and the second end defining a shank fixed to the disk such that the water slinging device is rotatable about the shoulder; the shoulder defining a tapered portion; the opening defining a correspondingly tapered portion; and wherein the tapered portion of the shoulder and the tapered portion of the opening interact when the disk rotates to force the water slinging device against the disk.

9. The shredder plate assembly of claim 8, further comprising a second rotatable water slinging device.

10. The shredder plate assembly of claim 6, wherein the fixed water slinging device defines a mounting tab extending therefrom, and the disk defines an opening receiving the mounting tab.

11. A method of rinsing an inside surface of a food waste disposer housing, comprising: attaching at least one water slinging device to a grind disk, the water slinging device having a sloped surface that slopes upwardly from the disk toward an outer portion of the disk and a web portion that extends radially inwardly along the grind disk from the sloped surface, the sloped surface oriented generally perpendicular to the web portion wherein the sloped surface extends along the disk generally perpendicularly from a vertical sidewall of the web portion where the vertical sidewall intersects the sloped surface; running water into an inlet of the food waste disposer; rotating the disk such that the water is directed by the web portion to flow up the sloped surface of the water slinging device and against the inside surface.

12. The method of claim 11, wherein attaching the water slinging device includes: inserting a rivet through an opening in the water slinging device, the rivet having a shoulder defining a tapered portion, the opening defining a correspondingly tapered portion; fastening one end of the rivet to the disk so that the water slinging device is rotatable about the shoulder; wherein the tapered portion of the shoulder interacts with the tapered portion of the opening to hold the water slinging device against the disk.

13. The method of claim 11, wherein attaching the water slinging device includes inserting a tab extending from the water slinging device into a corresponding opening in the disk.

14. The method of claim 11, wherein attaching the at least one water slinging device includes attaching a plurality of water slinging devices.

* * * * *

UNITED STATES PATENT AND TRADEMARK OFFICE

CERTIFICATE OF CORRECTION

PATENT NO. : 7,665,680 B2
APPLICATION NO. : 11/164976
DATED : February 23, 2010
INVENTOR(S) : Scott W. Anderson et al.

It is certified that error appears in the above-identified patent and that said Letters Patent is hereby corrected as shown below:

Column 5,
Line 20, Claim 7, "alone" should be --along--.

Signed and Sealed this

Ninth Day of November, 2010

David J. Kappos

David J. Kappos
*Director of the United States Patent and Trademark Office*